United States Patent [19]

Bardfeld

[11] Patent Number: 4,650,229

[45] Date of Patent: Mar. 17, 1987

[54] LOCK ARRANGEMENT FOR A DOOR PANEL

[75] Inventor: Rosalia Bardfeld, Vienna, Austria

[73] Assignee: Anstalt für Schliesstechnik

[21] Appl. No.: 749,302

[22] Filed: Jun. 27, 1985

[30] Foreign Application Priority Data

Jul. 2, 1984 [DE] Fed. Rep. of Germany ..... 3424305

[51] Int. Cl.[4] ..... E05C 1/12

[52] U.S. Cl. ..... 292/167; 292/347; 292/348; 292/353; 292/DIG. 27

[58] Field of Search ..... 292/167, DIG. 27, 353, 292/347, 348, 359, 139, 336.3

[56] References Cited

U.S. PATENT DOCUMENTS

| | | | |
|---|---|---|---|
| 95,024 | 9/1869 | King | 292/347 |
| 478,239 | 7/1892 | Richtmann | 292/167 X |
| 595,505 | 12/1897 | Wesling | 292/167 |
| 711,528 | 10/1902 | Richardson | 292/DIG. 27 X |
| 797,918 | 8/1905 | Schehr | 292/353 |
| 804,399 | 11/1905 | Hardenbergh | 292/DIG. 27 X |
| 969,725 | 9/1910 | Rees | 70/134 |
| 1,200,942 | 10/1916 | Higgins | 292/DIG. 27 X |
| 2,534,012 | 12/1950 | Gadpaille | 292/353 |
| 3,580,622 | 5/1971 | Morgan | 292/169 |
| 4,268,075 | 5/1981 | Allenbaugh | 292/167 |

FOREIGN PATENT DOCUMENTS

| | | | |
|---|---|---|---|
| 582040 | 10/1924 | France | 292/139 |
| 13666 | of 1885 | United Kingdom | 292/353 |
| 13672 | of 1885 | United Kingdom | 292/353 |

*Primary Examiner*—Robert L. Wolfe
*Assistant Examiner*—Lloyd A. Gall
*Attorney, Agent, or Firm*—Toren, McGeady and Goldberg

[57] ABSTRACT

A lock arrangement to be secured in a door panel is formed of as few parts as possible and includes a pair of knobs to be secured to the opposite sides of the door panel and an elongated latch bolt. The latch bolt is operated by an actuating pin eccentrically arranged within and extending between the knobs. The actuating pin interconnects the knobs so that they can be turned together. The knobs have the same outside configuration and the knob surfaces which face one another each have a recessed edge which fits into a bore formed in the door panel extending between the knobs. The actuating pin operating the latch bolt is located in the locking position of the bolt on an extension of the elongated direction of the bolt. A spring biases the bolt into the locking position. A retaining pin extends between and is centered relative to the knobs and secures the knobs to the door panel.

4 Claims, 4 Drawing Figures

LOCK ARRANGEMENT FOR A DOOR PANEL

BACKGROUND OF THE INVENTION

The present invention is directed to a knob operated locking device for use in a door panel with the knobs being interconnected by at least one actuating pin. The actuating pin is connected to a spring biased latch bolt so that by turning the knobs the latch bolt can be released from the locking position.

In known lock arrangements of this type, the knobs are mounted on the door panel by support members which are screwed to the door panel. Such an arrangement, however, suffers from the disadvantage that a number of different parts are required so that production and assembly costs are high and the arrangement is subject to frequent failures.

SUMMARY OF THE INVENTION

Therefore, it is the primary object of the present invention to provide a lock arrangement of the general type mentioned above which is made up of as small a number of individual parts as possible and can be easily adapted to various uses without changing the individual parts.

In accordance with the present invention, the lock arrangement includes a pair of knobs with identical outside configuration and shaped for direct insertion into a bore in the door panel, for example, the surfaces of the knobs which face one another on the door panel have a recessed circumferentially extending edge capable of being inserted into the bore in the door panel. The knobs are secured together by a retaining pin extending through the bore and between the knobs. An actuating pin extends between the knobs and is arranged eccentrically relative to the retaining pin. It is connected to the latch bolt which is biased by a spring into the locking position. In the locking position the actuating pin is located on an extension of the elongated direction of the latch bolts. Due to this construction, the lock arrangement can be formed of only a few parts so that the risk of failure is considerably reduced. The position of the knobs on the door panel is of no importance, since the latch bolt can be displaced out of the locking position by turning the knobs in either direction about the central axis of the knobs. Due to the spring biasing of the latch bolt into the locking position, the lock arrangement is biased toward the door edge in which the latch bolt is located. Accordingly the knobs are retained against the side of the bore closer to the edge of the door panel. As a result, the knobs are secured in position even if the bore through the door panel is not positioned precisely.

A particularly advantageous feature of the lock arrangement is to support the actuating pin secured to the latch bolt so that it is axially displaceable within the knobs whereby it can be released from one knob and the other can be turned to operate the latch bolt while turning the one knob has no effect on the latch bolt. Accordingly, the knobs can be released so that they do not turn together even when assembled on the door panel whereby opening the door from one side can be prevented. This feature is particularly desirable for doors to be locked from one side such as in bathrooms, lavatories, children's rooms or the like. Yet another feature is that the longitudinal axis of a tension member extending between the latch bolt and the actuating pin is in axial alignment with the long direction of the latch bolt so that the bolt can be easily displaced out of the locking position. Further, such displacement can be effected by turning the knobs in either direction. Moreover, the tension member can be made adjustable in length for adapting the degree of penetration of the latch bolt into the locking position. To provide the adjustment of the tension member it is made up of two telescopically arranged threaded parts for varying the overall length of the member. This feature is particularly beneficial, since doors are generally fabricated within a range of production tolerances so that for door panels of a substantially reduced width, there is the possible risk that the latch bolt fails to extend sufficiently into the locking recess to assure proper locking.

Another improvement in the present invention is the provision of tongues at one end of the retaining pin by which the pin can be secured into one of the knobs. This feature renders mounting of the knobs in the door panel very easy, since the knobs can be secured in position without the use of any screws. To mount the knobs on the door panel it is only necessary to position the retaining pin in one of the knobs and position it through the door panel so that the knob on the opposite side of the panel can be engaged by the tongues extending into the knob.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
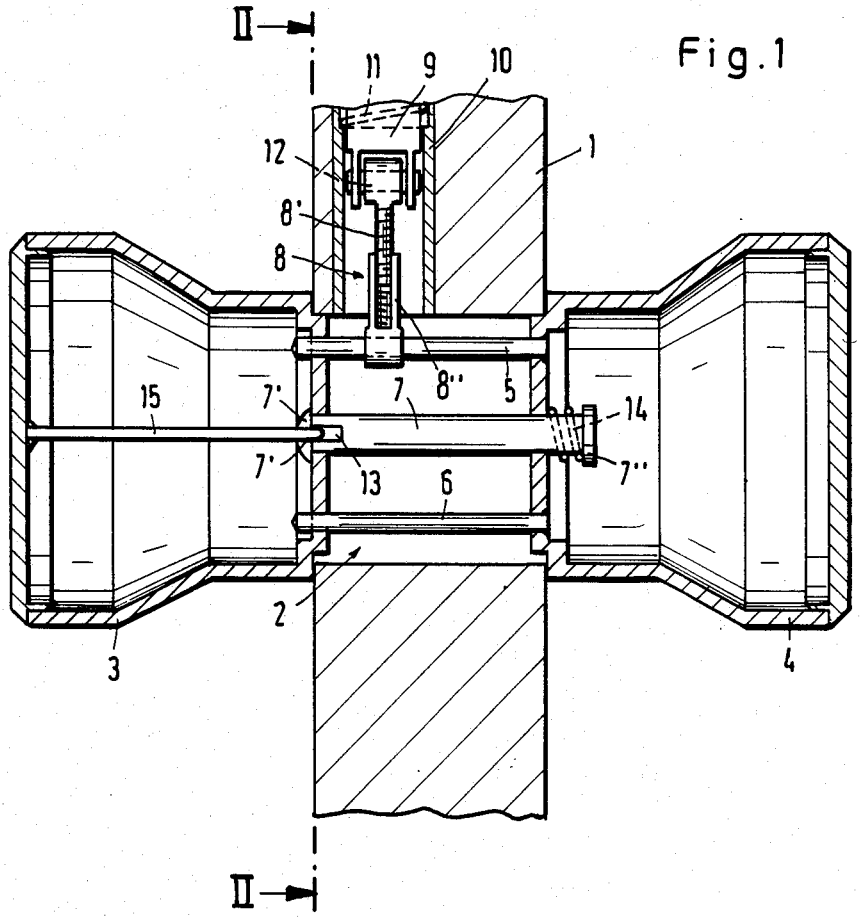
FIG. 1 is a horizontal sectional view of a first embodiment of the present invention taken along the line I—I in FIG. 2.
Figure 2:
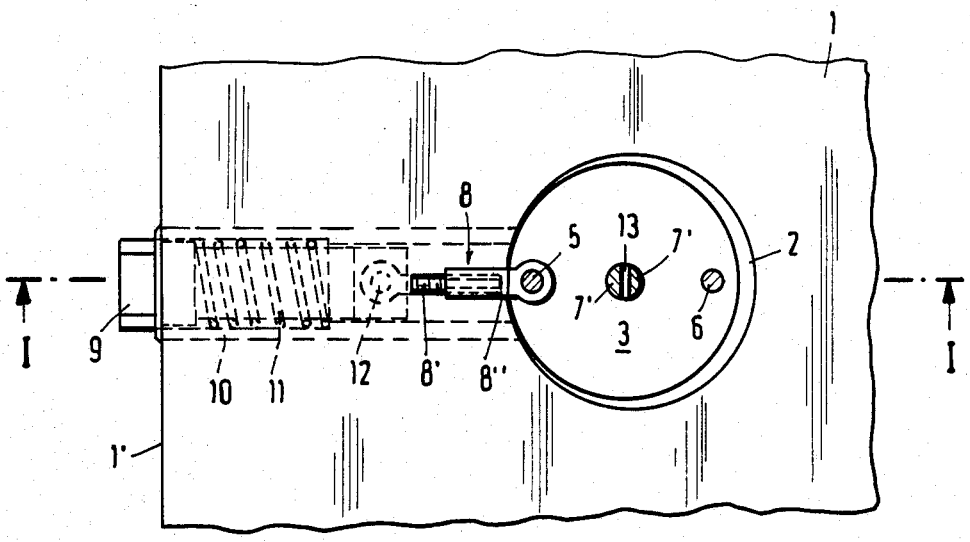
FIG. 2 is an elevational view taken along the line II—II in FIG. 1 with the knob on the left-hand side in FIG. 1 being omitted.

In FIG. 1 a door panel 1 is illustrated having a throughbore 2 with an axis extending at right angles to the face surfaces of the door panel. Each of a pair of knobs 3, 4 is inserted into an opposite end of the bore so that one knob is accessible on each of the opposite face surfaces of the door panel. The knobs 3, 4 are hollow members and have a similar exterior configuration. Each knob can be turned about a central axis arranged generally parallel with the axis of the bore 2. Each knob has an inner face directed toward the door panel and an outer face facing outwardly away from the panel. A circumferential surface encircles the central axis of the knob and extends between the inner face and the outer face. For supporting the knobs in the bore 2, the radially outer edge of the inner face of each knob is stepped inwardly affording an annular recess whereby the inner face or engaging end of the knob is encircled by a cylindrical portion slightly smaller in diameter than the bore 2. This cylindrical portion fits into the bore. Knobs 3, 4 are interconnected so that they can be turned together by two pins 5, 6 located on diametrically opposite sides of a central retaining pin 7. As can be seen in FIGS. 1 and 2, the pins 5 and 6 are located adjacent the radially outer edge of the inner face of the knobs. Pin 5 serves as an actuating pin in engagement with a tension member 8 connected to a latch bolt 9 so that the latch bolt can be displaced from a locking position by turning the knob.

As can be noted in FIG. 1, the pins 5, 6 are mounted in the inner face of knob 4 and extend through the bore 2 and pass through openings formed in the inner face of the knob 3. Similarly, the retaining pin 7 is positioned within the hollow interior of the knob 4 and extends through the inner face of the knob 4, through the bore 2, and through an opening in the inner face of the knob 3.

Figure 3:
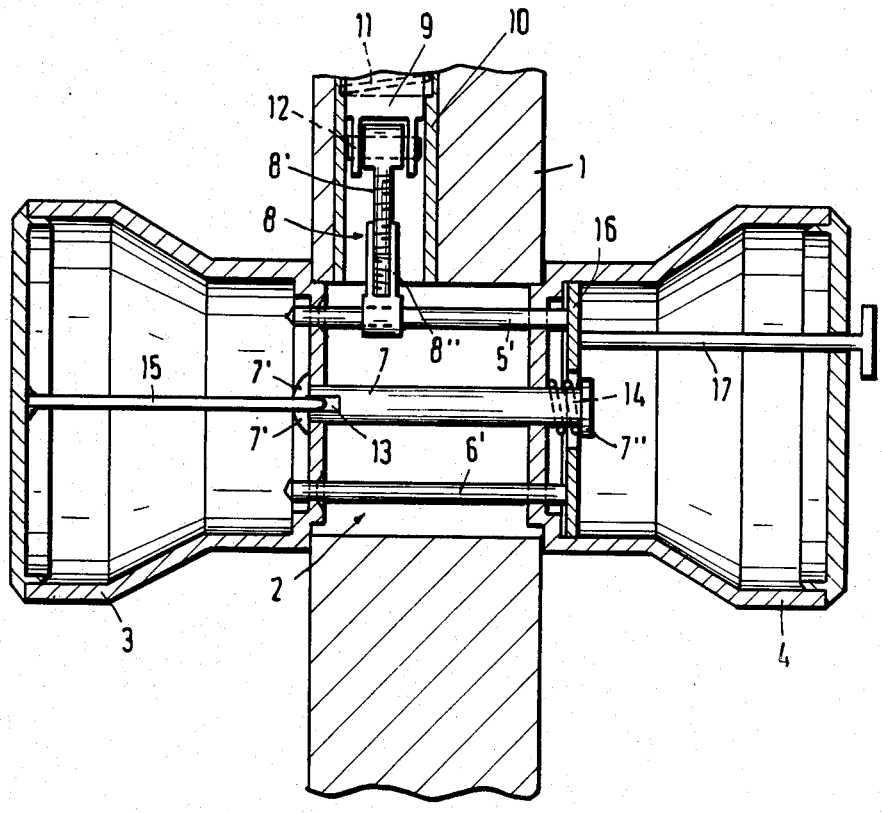
FIG. 3 is a horizontal sectional view, similar to FIG. 1, of a second embodiment of the present invention.

In FIG. 3 pins 5', 6' are axially displaceable relative to the knobs 3, 4 so that the pins can be withdrawn from the bores 3' in the inner face of the knob 3 for releasing the interengagement of the knobs in the turning action. In other words, if the pins 5', 6' are displaced out of the bores 3' in the knob 3, the knob 4 can be turned without turning the knob 3. Within the knob 4 the pins 5', 6' are secured to an annular disc 16 located adjacent to the inside surface of the inner face of the knob. A setting lever or pin 17 is attached to the annular disc so that by withdrawing the disc away from the inner face of the knob, the pins 5', 6' are displaced axially and are released from engagement with the inner face of the knob 3. If the pins 5', 6' are withdrawn from the corresponding bores 3' in the inner face of the knob 3, the door can be opened by turning knob 4, while turning knob 3 will not have any effect on the locking position of the latch bolt 9.

This embodiment is suitable to render the assembly adaptable to certain desired applications, for example, as a lock for use in bathrooms, lavatories, children's rooms and the like. In these various applications, the knob 4 remains in engagement with the tension member 8 and is invariably arranged on the side of the door within the room so that the door is locked from the inside.

Figure 4:
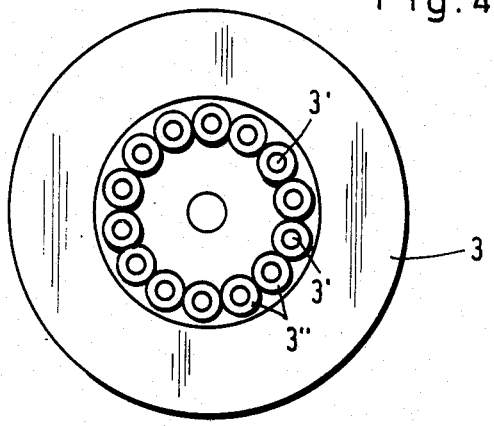
FIG. 4 is an elevational view of the surface of the knob on the left-hand side of FIG. 3 which faces the door.

The bores 3' in the inner face of knob 3 for receiving the pins 5', 6', note FIG. 4, are equidistantly arranged around a circle adjacent the radially outer edge of the inner face and each bore has a circumferentially extending chamfered surface or countersunk surface 3'' so that the pins 5', 6' are led into the bores regardless of the relative positions of the knobs.

As illustrated in FIGS. 1 and 3, the latch bolt 9 is slidably guided in a sleeve 10 extending transversely of the edge 1', note FIG. 2, of the door panel 1 and of the axis of the bore 2. Latch bolt 9 is biased by a spring 11 in the direction away from the bore 2. The spring 11 may be firmly secured to the latch bolt 9 biasing the bolt outwardly from the sleeve so that the biasing action through the medium of the tension member 8 and the actuating pin 5 draws the knobs 3, 4 against the surface of the bore 2 adjacent the latch bolt 9. As can be seen in FIGS. 1 and 3, the diameter of the inner face of the knobs 3, 4 is smaller than the diameter of the bore 2 with the action of the spring 11 pressing the knobs against the side of the bore through which the tension member 8 projects.

It would also be possible to omit the sleeve 10 so that the opening through the door containing the tension member 8 and the latch bolt 9 would serve as a guide means for the latch bolt. The tension member 8 is pivotally secured to one end of the latch bolt by a pin 12. To further simplify the design of the locking arrangement, the tension member 8 could be formed as an integral part of the latch bolt 9, for example, by molding them as an integral component.

Tension member 8 is formed of two telescopically arranged threadedly engaged parts 8', 8'' for affording adjustment of the overall length of the tension member. The part 8' is threaded on its outside surface and extends into the sleeve-like part 8''. Part 8' connects the tension member to the latch bolt while part 8'' effects the connection with the actuating pin 5. Adjustment of the length of the tension member is effected to establish the extent to which the latch bolt 9 projects outwardly from the edge 1' of the door panel 1.

In most cases it may be sufficient, however, to adjust the depth penetration of the latch bolt into the locking recess by providing interchangeable tension members of different lengths.

Central retaining pin 7 has at one end, shown within the knob 3 in FIGS. 1 and 3, two end pieces which may be resilient tongues 7' separated by an axial slit 13. At its opposite end the retaining pin 7 has a collar or head 7'' projecting laterally outwardly from the surface of the pin. The collar 7'' forms an abutment for a spring 14 so that the spring extends between the collar and the inside surface of the inner face of the knob 4. Resilient tongues 7' form a snap-in lug mechanism which engages the inside surface of the inner face of the knob 3. As a result, the knobs are held together by the tensile load developed by the spring 14 and both knobs are pressed against the opposite face surfaces of the door panel 1. In addition, the assembly of this locking arrangement is rendered easy, since to secure both knobs together, it is necessary to insert the central retaining pin into the knob 4 from the outside and to move the pin through the corresponding opening in the knob 3 with the resilient tongues in the leading position, so that the tongues snap outwardly into engagement with the inside surface of the inner face of the knob 3 with the knobs being drawn against the surfaces of the door panel by the spring 14.

For firmly securing the resilient tongues 7' in the locked position, the knob 3 can be provided with a central extension 15 extending from the inside surface of the outer face into the opening through the inner face through which the retaining pin 7 extends. As can be seen in FIGS. 1 and 3 the extension 15 projects into the slit 13 between the resilient tongues and prevents them from slipping out of locking engagement. It is also feasible to manufacture both pins 5, 6 and retaining pin 7 as an integral part of the inner face of the knob 4, for example by injection molding for affording improved design simplicity. Such an arrangement is particularly suitable if a large number of doors of equal thickness are to be equipped with the locking arrangement according to the present invention.

In place of the retaining pin 7 as illustrated, the central pin may be formed as a headed screw or the like with the knobs being secured relative to one another by means of a nut. In such an arrangement, the spring could be dispensed with as the abutment of the knobs against the door panel could be adjusted by further screwing down with the nut.

Knobs 3 and 4 could also be held in place in the bore 2 through the door panel 1 by decorative discs, not shown, encircling the face surfaces of the door panel at the bore. Such decorative discs can be provided with one or more projecting lugs extending in the axial direction of the bore 2 so as to be secured in the bore with the reduced diameter cylindrical portions of the knobs fitting into the discs.

In summation it is to be noted that in the most simple arrangement of the described locking arrangement only three elements are used and the knobs can be duplicates of one another. The three elements include all of the features necessary for effecting the desired operation of the locking arrangement.

For joining the elements of the locking arrangement together after they have been placed and aligned in the door panel, it is only necessary to press them together. No screws or other types of screw connections are required, since all of the features needed for securing the locking arrangement to the door panel are included in the three elements. Due to the special design of the locking arrangement embodying the present invention, an accurate cutout in the door panel, which is a main requirement of all known knob operated locking systems consisting of large number of parts, is not required. Due to the arrangement of the actuating pin as close as possible to the effective circle, dead areas are omitted as the locking position is defined by the special overall assembly of the locking arrangement in the bore of the door panel. Accordingly, the locking arrangement can be actuated by turning the knobs clockwise or counterclockwise.

By minor changes in one element, the described locking arrangement can be adapted easily for special uses, for example for utilization in rooms to be locked from one side only, such as bathrooms, lavatories, children's rooms and the like so that one of the two knobs can be turned without releasing the latch bolt from the locking position. With such idle turning it is possible to prevent the door knob from being damaged by improper or malicious handling.

Because all of the elements of the arrangement are simple in design, the extent of manufacturing control can be reduced, inventory can be kept to a minimum, delivery can be easily supervised, maintenance and repair are routine jobs, and there are few causes of failure.

While specific embodiments of the invention have been shown and described in detail to illustrate the application of the inventive principles, it will be understood that the invention may be embodied otherwise without departing from such principles.

I claim:

1. In an activation device for a lock arrangement having a sliding bolt, said actuation device including two turning knobs arranged in a throughbore in a door panel on opposite sides thereof, a centrally arranged connecting segment for connecting said turning knobs one to the other through said throughbore, and an eccentrically acting actuating element operable by both of said turning knobs for actuating said sliding bolt, the improvement which comprises said turning knobs being identically constructed, each comprising a first circular portion for engaging said throughbore, a second circular portion for limiting said engagement of said throughbore by said first circular portion, and a central axial hole in an engaging end of said first circular portion, said connecting segment comprising a first pin for passing through said hole in each of said turning knobs, said first pin having a flange at one end to capture said first pin in one of said knobs and flexible tab means at the other end of said first pin for lockingly engaging the hole in said other knob, and wherein said eccentrically acting actuating element comprises a second pin for engaging off-centered axial holes also formed in said engaging ends of said turning knobs, and a tension member slidably engaging said second pin for selectably sliding said sliding bolt in response to either of said knobs being turned, wherein said second pin slidably engages said off-centered axial holes and said device includes means for selectively retracting said second pin into one of said turning knobs out of engagement with the off-centered axial hole in the other of said turning knobs, whereby said other turning knob can no longer operate said eccentrically acting actuating element.

2. An actuation device as claimed in claim 1 wherein said device further comprises a third pin for engaging further off-centered axial holes formed diametrically opposite said off-centered axial holes in said engaging ends of said turning knobs.

3. An actuation device as claimed in claim 1 wherein said flexible tab means comprises said first pin having a slot formed in the end thereof forming two end pieces, and said end pieces having means thereon for engaging an inner surface of the engaging end of one of said turning knobs around said central axial hole.

4. An actuation device as claimed in claim 3 wherein a central extension is positioned in said one turning knob for engaging said slot when said end pieces of said first pin are inserted into said central axial hole, whereby said central extension prevents said engaging means from disengaging from said inner surface.

* * * * *